US005535819A

United States Patent [19]

Matsuura

[11] Patent Number: 5,535,819

[45] Date of Patent: Jul. 16, 1996

[54] HEAT EXCHANGER

[75] Inventor: Satoshi Matsuura, Takahama, Japan

[73] Assignee: Nippondenso Co., Ltd., Kariya, Japan

[21] Appl. No.: 331,191

[22] Filed: Oct. 28, 1994

[30] Foreign Application Priority Data

Oct. 28, 1993 [JP] Japan ..... 5-270825

[51] Int. Cl.$^6$ ..... F28F 9/007

[52] U.S. Cl. ..... 165/149; 165/67; 165/153; 165/DIG. 480

[58] Field of Search ..... 165/67, 149, 151, 165/153, 173

[56] References Cited

U.S. PATENT DOCUMENTS

| | | | |
|---|---|---|---|
| 3,246,691 | 4/1966 | La Porte et al. | 165/151 |
| 4,763,723 | 8/1988 | Granetzke | 165/67 |
| 4,862,953 | 9/1989 | Granetzke et al. | 165/67 |
| 5,046,555 | 9/1991 | Nguyen | 165/173 |
| 5,265,672 | 11/1993 | Aoki | 165/149 |
| 5,348,079 | 9/1994 | Tanaka | 165/67 |
| 5,429,182 | 7/1995 | Hanafusa | 165/67 |
| 5,441,100 | 8/1995 | Ueda et al. | 165/67 |

FOREIGN PATENT DOCUMENTS

| | | | |
|---|---|---|---|
| 4120869 | 1/1993 | Germany | 165/149 |
| 92492 | 7/1990 | Japan . | |
| 244596 | 9/1992 | Japan | 165/149 |
| 248783 | 9/1993 | Japan | 165/149 |

*Primary Examiner*—Leonard R. Leo
*Attorney, Agent, or Firm*—Cushman, Darby & Cushman

[57] ABSTRACT

A heat exchanger with a simple configuration and having a high strength is disclosed. The heat exchanger is configured by sandwiching both sides of a core created by layering tubes and corrugated fins by a pair of side plates and brazing the connecting bar on the ends of each tube and side plate with the bar inserted into header. The header and side plate are coupled with a approximately U-shape coupling member in addition to the connecting bar 13. This coupling member is configured of an arc section that covers the header and an arm section that has a locking section to lock onto a ⊐-shaped bend section of side plate. The arc section is fixed onto header with brazing, and arm section is fixed to side plate. The vibration conveyed from the bracket to the side plate is conveyed to the header via the connecting bar and coupling member, and the strength of the coupling sections of the header and side plate is much higher than the strength found in conventional structures.

15 Claims, 16 Drawing Sheets

HEAT EXCHANGER

CROSS REFERENCE TO RELATED APPLICATIONS

This application is based upon and claims priority from Japanese Patent Application filed Oct. 28, 1993, the contents of which are incorporated herein by reference.

BACKGROUND OF THE INVENTION

1. Field of the Invention

This invention relates to a heat exchanger in which both ends of the core are sandwiched by a pair of side plates.

2. Related Art

Japanese Utility Model Application Laid-open Patent No. 2-92492 discloses a heat exchanger in which both ends of a core are sandwiched by a pair of side plates. This heat exchanger is composed of a core in which tubes and corrugated fins are layered, a pair of headers engaged to both ends of each tube, and a pair of side plates sandwiching the cores from both sides and fixed to the header. The strength of the heat exchanger is improved by coupling the pair of headers and pair of side plates and fixing them.

The side plate is bent in a cross-section so as to have a ⊐-shape (reverse c-shape) to improve its strength as shown in FIG. 23. However, the shape of connecting bar 103 of side plate 102 that couples the header 101 and side plate 102 is flat because the end of side plate 102 is generally inserted into header 101 and brazed.

When the heat exchanger is installed on an item that vibrates, such as a vehicle, the effect of the vibration is applied on connecting bar 103 of side plate 102 that has a low strength. Thus, it has been known for conventional devices to suffer easy breakage of the connecting bar.

If a flat section is not formed between ⊐-shape bent section 104 of side plate 102 and the header 101, it becomes difficult to assemble core 105 and header 101. Thus, the flat section between ⊐-shape bent section 104 and header 101 cannot be eliminated.

SUMMARY OF THE INVENTION

The object of the present invention is to provide a heat exchanger with a simple configuration and high strength.

To achieve the object of the present invention, the following configuration has been used in the design of the heat exchanger according to the present invention. The heat exchanger includes multiple tubes having a fluid path formed internally and a core created by layering multiple corrugated fins formed in wavy form, a header engaged to the ends of the above-mentioned multiple tubes and a connecting bar fixed to this header, and a pair of side plates coupled with the header in a state where the above-mentioned core is sandwiched from both sides. The above-mentioned header and side plates are coupled with coupling members.

The heat exchanger may also be structured as follows. It may include multiple tubes having a fluid path formed internally and a core created by layering multiple corrugated fins formed in a wavy form, a header configured of a cylinder engaged to the ends of the above-mentioned multiple tubes and a cap engaged to both ends of this cylinder and that blocks the ends of the cylinder, a connecting bar fixed to the above-mentioned header, and a pair of side plates coupled with the header in a state where the above-mentioned core is sandwiched from both sides.

The above-mentioned cap and side plates are coupled with coupling members.

In the heat exchanger according to the present invention, the header and side plates are coupled with the side plates' connecting bar. Furthermore, as the header and side plates are also coupled by coupling members, the header and side plate coupling strength is increased. Therefore, the vibration or load applied on the header or one side plate is passed through the connecting bar and coupling member and conveyed to the side plate or other end of the header, and thus, the vibration or load force is not concentrated on the coupling section of the header and side plate. In the same manner, in a second embodiment of the present invention, the coupling strength of the header and side plate is increased as the header and side plates are coupled with the side plates' connecting bar and the header end cap and side plate are also coupled by a coupling member. Therefore, the vibration or load applied on the header or one side plate is passed through the connecting bar or coupling member and conveyed to the side plate or other end of the header, and thus, the vibration or load force is not concentrated on the coupling section of the header and side plate.

The present invention has a simple configuration in which the header and side plate are coupled with coupling members or the cap and side plate are coupled with coupling members. Thus, the strength of the heat exchanger can be improved, and damage to the heat exchanger can be prevented.

BRIEF DESCRIPTION OF THE DRAWINGS

Other features and characteristics of the present invention as well as the function of related elements of the structure will become apparent to one of ordinary skill in the art from a study of the subject application and the appended claims and drawings, all of which form a part of this application. In the drawings, like reference numeral represent like elements and:

DETAILED DESCRIPTION OF THE PRESENTLY PREFERRED EXEMPLARY EMBODIMENTS

The heat exchanger according to the present invention will be explained with reference to the appended figures.

Figure 3:
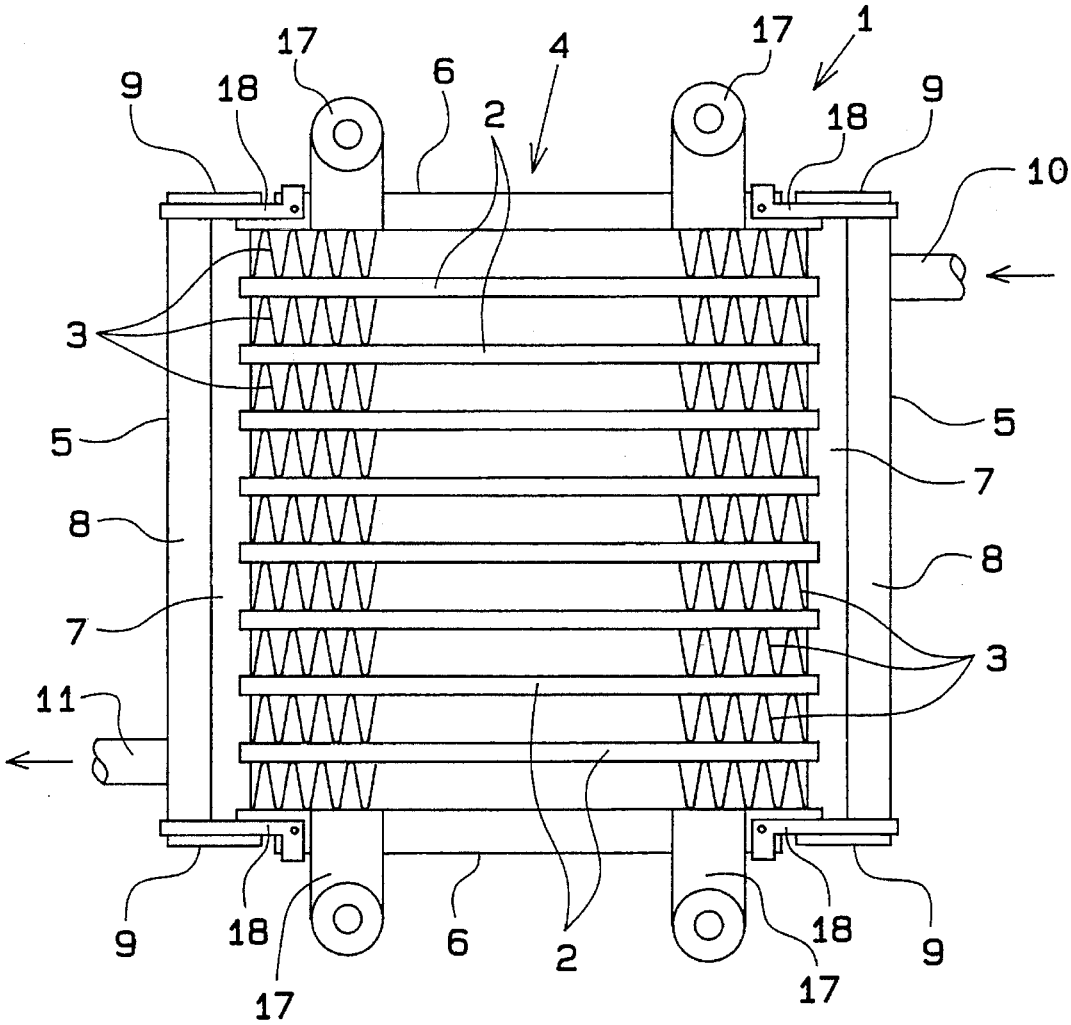
FIG. 3 is a side view of the first embodiment.

FIGS. 1 through 6 illustrate a first embodiment of the present invention. FIG. 3 shows a schematic view of the heat exchanger of the first embodiment in the present invention.

Heat exchanger 1 used for the refrigerant condenser is formed with metallic material such as brass an/or aluminum. Heat exchanger 1 includes core 4 in which tubes 2 and corrugated fins 3 are alternately layered. A pair of headers 5 is engaged to both ends of each tube 2, and a pair of side plates 6 is coupled to the pair of headers 5 in a state where core 4 is sandwiched therebetween.

Tubes 2 are flat tubes having multiple paths inside to exchange the heat of the refrigerant flowing inside and the air passing between tubes 2. Corrugated fins 3 are engaged with tubes 2 in a state where the fins are sandwiched between each tube 2. These fins help improve the heat exchanging efficiency with the air flowing between tubes 2. Corrugated fins 3 are created by bending band-shape ultra-thin plates into a wavy shape. Generally, multiple louvres are formed on corrugated fins 3 to improve the heat exchange efficiency. Corrugated fins 3 are brazed, so brazing material is clad and formed on the surface.

Header 5 is a cylindrical tank having header plate 7 in which each tube 2 is inserted, and header tank 8 assembled with header plate 7. The cylinder is formed by assembling header plate 7 and header tank 8. Header 5 is configured with a cylindrical tank in which cap 9 covers over the ends of the cylinder formed by assembling header plate 7 and header tank 8. Cap 9 has multiple claws 9*a* that catch the periphery of the cylindrical header plate 7 and header tank 8. Header plate 7, header tank 8 and cap 9 have brazing material clad and formed on both sides thereof.

Figure 4:
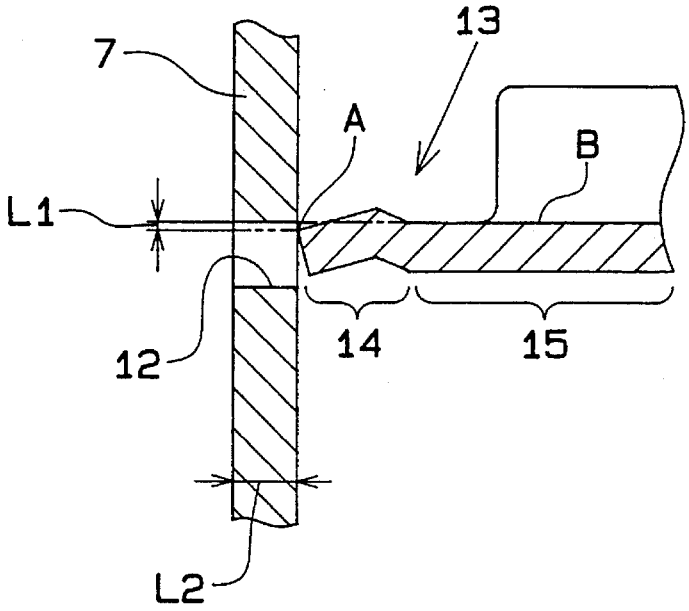
FIG. 4 is a cross-sectional view showing the connecting bar on the side plate and the header plate in the first embodiment.
Figure 5:
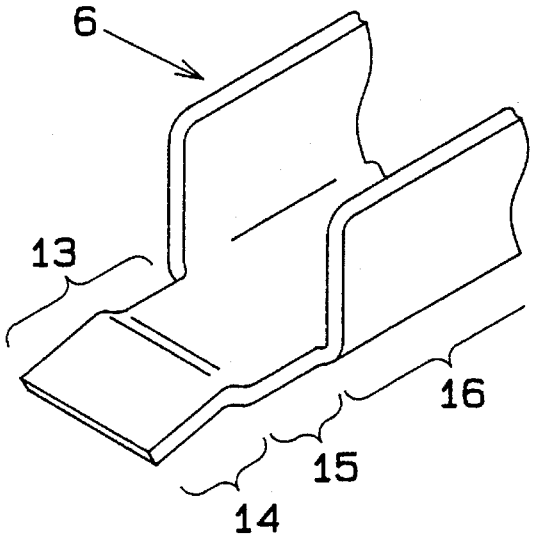
FIG. 5 is a perspective view of the connecting bar on the side plate in FIG. 4.
Figure 6:
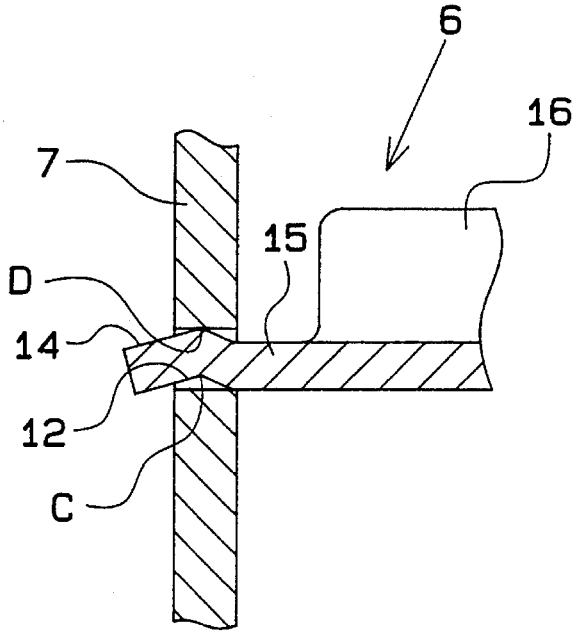
FIG. 6 is a cross-sectional view illustrating the insertion section inserted into the insertion hole.

On one header 5, inlet pipe 10, through which refrigerant flows into header 5, is connected, and on the other header 5, outlet pipe 11 for discharging the refrigerant is connected. Side plate 6 is a press-machined part bent into a cross-section ⊐-shape or U-shape excluding both ends. Hereinafter ⊐-shape is used as a representation. Brazing material is clad on the sides that directly contact corrugated fins 3. Flat connecting bar 13 for inserting into insertion hole 12 in header plate 7 is formed on both ends of side plate 6 as shown in FIGS. 4 through 6. Connecting bar 13 is formed of insertion section 14 inserted into insertion hole 12 and flat section 15 having a designated length that is exposed between side plate 6 ⊐-shaped bend section and header 5. Flat section 15 is formed to improve the assembly properties of core 4 and header 5.

The end of insertion section 14 of side plate 6 in this embodiment is formed as an approximate ∧-shape (hook-shape) slanted toward the center of header 5. Position A on cap side of the end of insertion section 14 is positioned by length L1 toward the center of header 5 from surface B on the inner base of the ⊐-shaped bend section 16 (surface that differs from the fin surface that directly contacts corrugated fin 3). The ∧-shaped indent C (FIG. 6) is fitted with insertion hole 12 on header plate 7, and ∧-shaped bend peak section D is pressed against the inner wall of insertion hole 12 as shown in FIG. 6. Thus, by bending insertion section 14 in a ∧-shape, insertion section 14 fits with insertion hole 12.

The reason that the end of side plate 6 is slanted toward the center of header 5 as described with respect to the present embodiment is set forth below. When core 4 is brazed, the brazing material clad on the surface of each tube 2 melts, so core 4 shrinks in the direction of layers of tubes 2 and corrugated fins 3. Thus, layer direction dimensions of core 4 are designed in consideration of the shrinkage that occurs during brazing. In other words, core 4 is designed longer in the layer direction before brazing.

On the other hand, the position of header plate 7 insertion hole 12 in which side plate 6 is inserted, is designed to be an adequate position after brazing. Thus, if core 4 and header 5 are assembled before brazing, the position of side plates 6 on both ends of core 4 do not match the position of header plate 7 insertion hole 12. Conventionally, core 4 was compressed in the layer direction with a jig, etc., when assembling core 4 and header 5 to reduce the dimension in the layer direction, and the position of the end of side plate 6 (insertion section 14) and header plate 7 having insertion hole 12 were aligned. Thus, means to compress core 4 were required when assembling each core 4. Furthermore, after core 4 and header 5 were assembled, if the insertion section 14 was linear, core 4 and header 5 came apart easily when any movement took place. Thus, the pair of side plate 6 were locked so that the length of the pair of headers 5 did not change during movement or transportation.

By bending the insertion section 14 into an approximate ∧-shape as in this embodiment, insertion section 14 can be inserted into insertion hole 12 without compressing assembled core 4 in the layer direction. This improves the assembly of core 4 and header 5. Furthermore, by fitting the ∧-shaped indent C with insertion hole 12 and pressing the ∧-shaped bend peak against the inner wall of insertion hole 12, core 4 and header 5 fit. Thus, jigs for holding the assembled structure are not required when moving or transporting assembled core 4 and header 5.

Bracket 17 is brazed onto the ⊐-shaped bend section 16 of side plate 6 for installation of heat exchanger 1 onto a vehicle.

Figure 1:
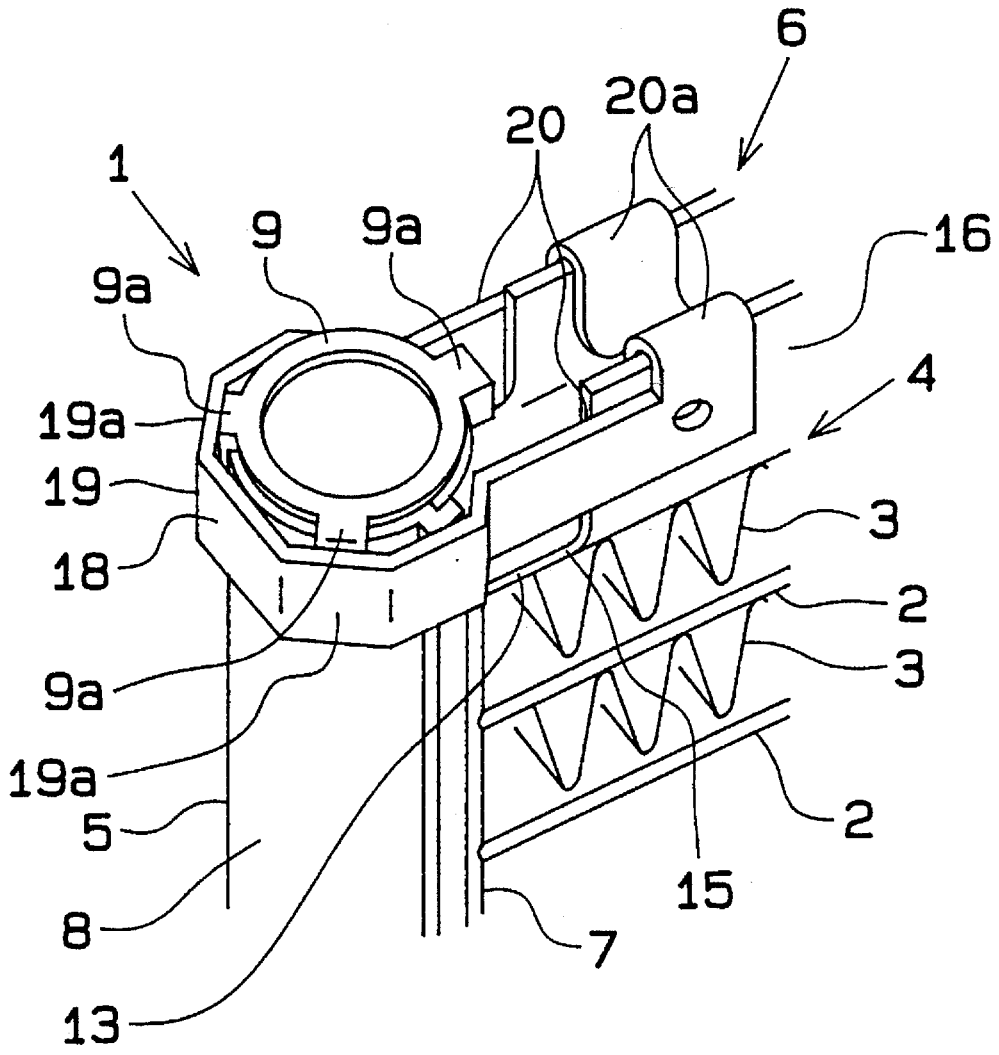
FIG. 1 is a partial perspective view of the heat exchanger in the first embodiment of the present invention.
Figure 2:
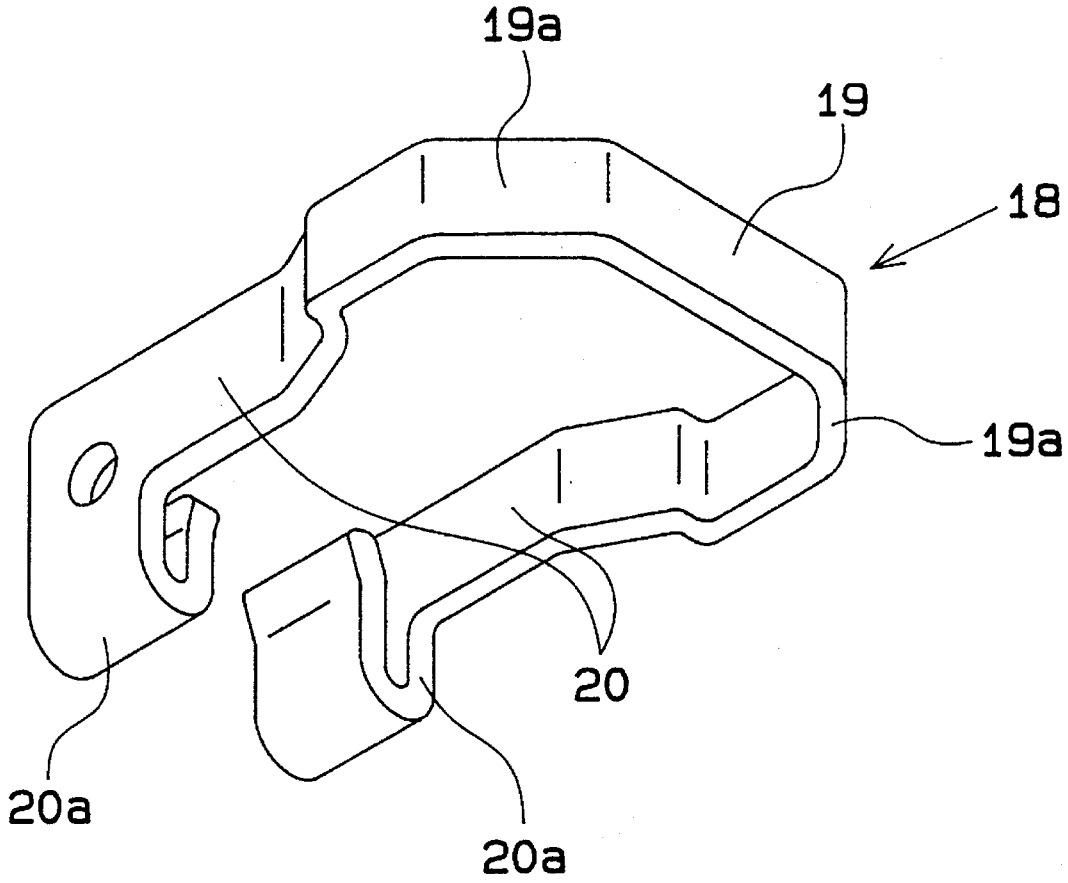
FIG. 2 is a perspective view of the coupling member used in the first embodiment.

Headers 5 and side plates 6 are coupled with coupling members 18 at the four corners of heat exchanger 1 as shown in FIGS. 1 and 3. Coupling member 18 is an approximate U-shape composed of arc section 19 brazed on the header to directly contact the outer side of header 5 and two arms brazed in a state to be locked on the ⊐-shape bend section 16 of side plates 6. Multiple indents 19*a* are formed on arc section 19 to fit and cover claws 9*a* on cap 9. Locking sections 20*a* that sandwich the side plates 6 are formed on the arm section 20.

After being brazed, heat exchanger 1 is installed on a vehicle with bracket 17. Thus, the vibration of the vehicle is conveyed to side plates 6 via bracket 17. The vibration conveyed to side plate 6 is then conveyed to header 5 via connecting bar 13 of side plate 6 and coupling member 18. Thus, the vibration is not centered only on connecting bar 13 of side plate 6 as it is in a conventional structure, and the strength at the connection sections of header 5 and side plate 6 is much higher than the conventional structure.

Heat exchanger 1 according to the first embodiment has a simple configuration in which header 5 and side plate 6 are coupled with coupling member 18. This allows the strength of heat exchanger 1 to be increased, and even if vibrations, etc., of the vehicle are conveyed to heat exchanger 1 via bracket 17, damage to heat exchanger 1 can be prevented.

Figure 7:
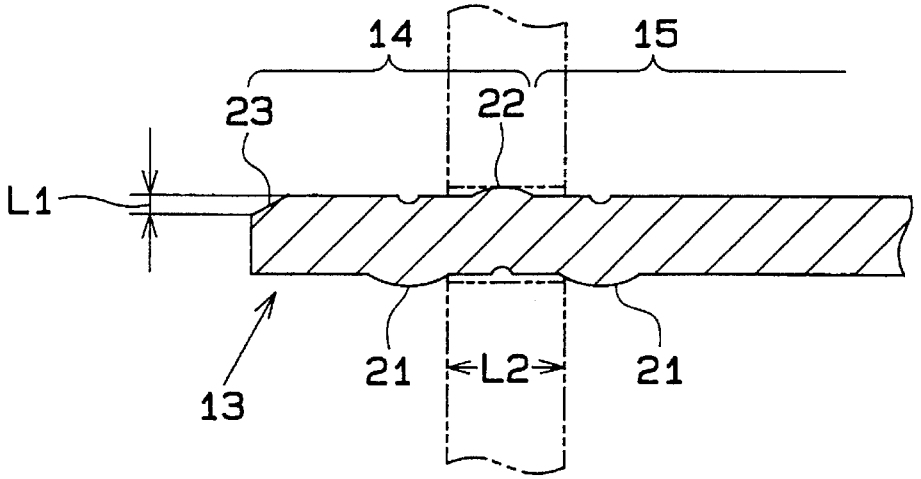
FIG. 7 is a cross-sectional view depicting the shape of the connecting bar on the side plate in the second embodiment.
Figure 8:
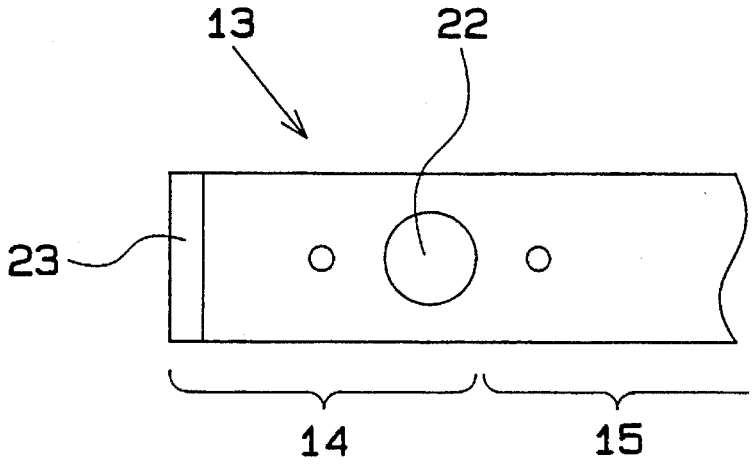
FIG. 8 is a top view showing the shape of the connecting bar on the side plate in the second embodiment of the present invention.

FIGS. 7 and 8 illustrate a second embodiment of the present invention. FIG. 7 is a cross-sectional view of connecting bar 13, and FIG. 8 is a top view of connecting bar 13. In this embodiment, insertion section 14 is not bent in a ∧-shape as in the first embodiment. Instead, two spherical fitting protrusions 21 that fit into the plate thickness L2 of header plate 7, as compared with the structure of FIG. 4 according to the first embodiment, are formed on one side of insertion section 14. On the other side of insertion section 14, spherical press-fit protrusion 22 pressed against insertion hole 12 is formed. By forming two fitting protrusions 21 and one spherical press-fit protrusion 22 on connecting bar 13, insertion section 14 fits with insertion hole 12, and jigs to hold the assembled structure are not required when moving or transporting the structure, like the first embodiment.

As in the first embodiment, by forming taper section 23 on the end of insertion section 14, core 4 and header 5 can be easily assembled without compressing core 4 in the direction of the layers.

Figure 9:
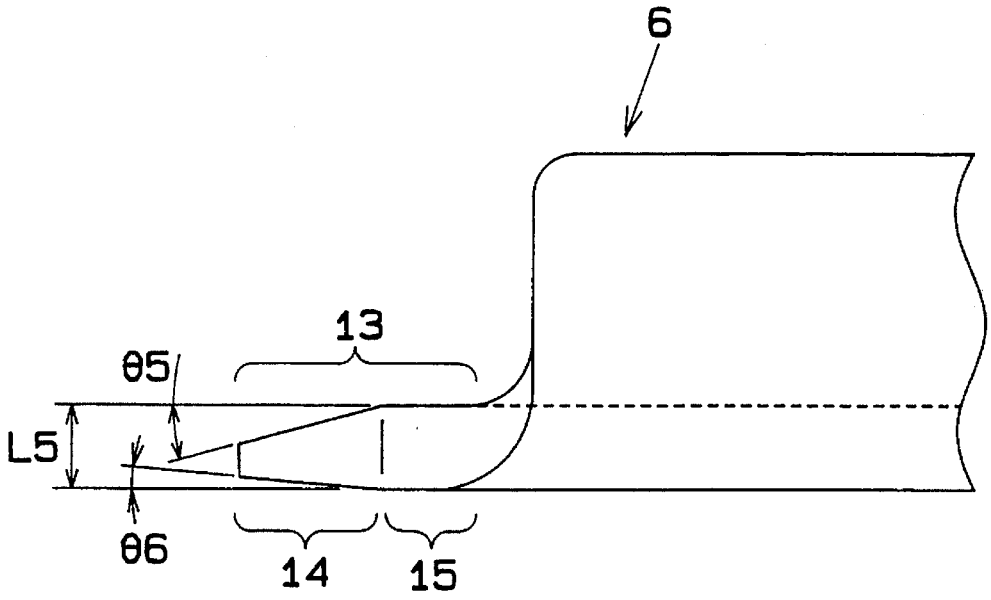
FIG. 9 is a side view showing the shape of the connecting bar on the side plate according to a third embodiment of the present invention.
Figure 10:
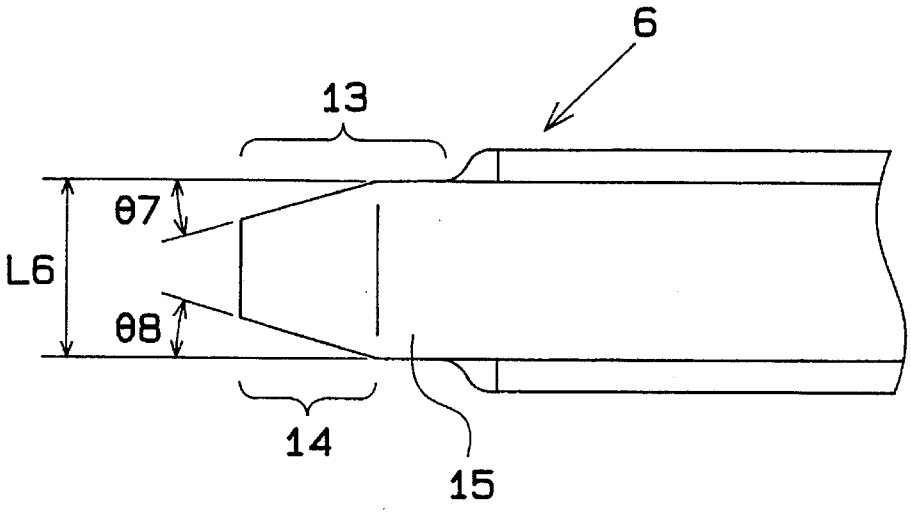
FIG. 10 is a top view showing the shape of the connecting bar on the side plate.
Figure 11:
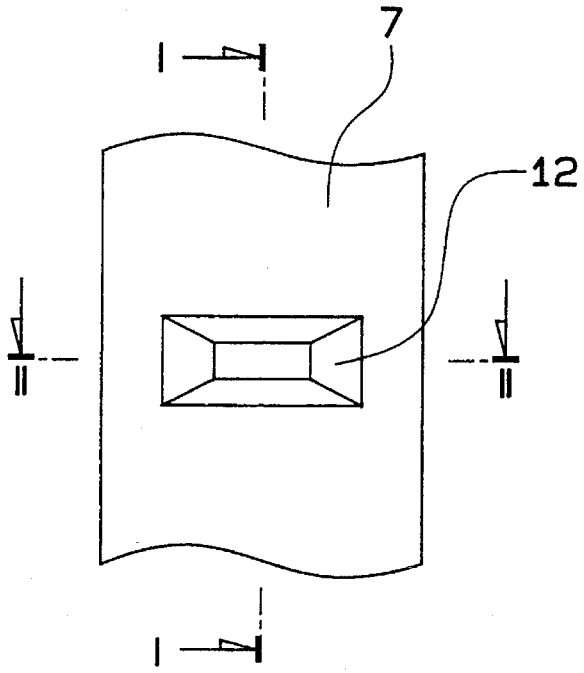
FIG. 11 is a front view of the insertion hole on the header plate.
Figure 12:
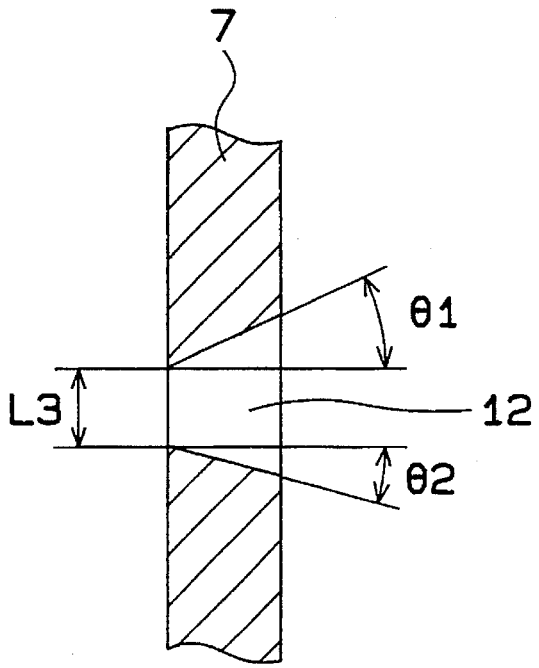
FIG. 12 is a cross-sectional view taken along the line I—I in FIG. 11.
Figure 13:
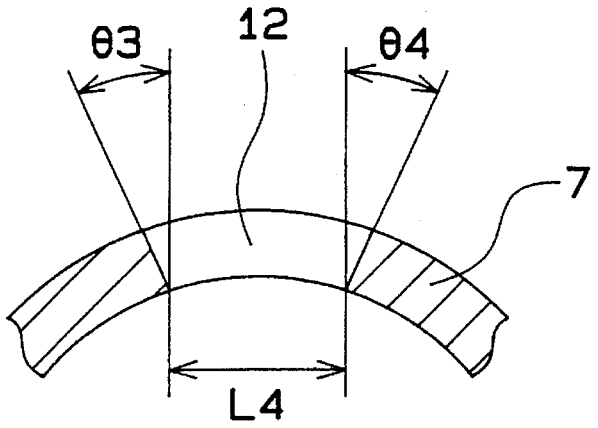
FIG. 13 is a cross-sectional view taken along the line II—II in FIG. 11.

FIGS. 9 to 13 illustrate the third embodiment of the present invention. FIGS. 9 and 10 show connecting bar 13 of side plate 6, and FIGS. 11 to 13 show insertion hole 12 on header plate 7.

As in the first and second embodiments, insertion section 14 is not inlaid and fit into insertion hole 12 in the third embodiment, but is temporarily fixed by press-fitting insertion section 14 into insertion hole 12.

Thus, each plane of side plate 6's insertion section 14 has a tapered shape that narrows toward the end section, and each plane of insertion hole 12 into which insertion section 14 is inserted has a tapered shape that widens in the direction in which insertion section 14 is inserted.

The inclination angle of each taper is set so that the inclination angle of insertion section 14 is larger than the inclination angle of insertion hole 12. If the inclination angle of insertion hole 12 is θ1 to θ4 and the inclination angle of insertion section 14 is θ5 to θ8, the inclination angles are such that θ5>θ1, θ6>θ2, θ7>θ3 and θ8>θ4. Furthermore, the dimensions of the inner side of insertion hole 12 are set to match the middle dimensions of the taper of insertion section 14. If insertion hole 12 inner side dimensions are L3 and L4, and the middle taper dimensions of insertion section 14 are L5 and L6, the dimensions are such that L3=L5 and L4=L6.

Furthermore, as the end of insertion section 14 is formed so as to taper, core 4 and header 5 can be assembled easily without compressing core 4 in the layer direction.

A possible modification is that the planes θ2 to θ4 and θ6 to θ8, i.e. those other than plane θ5 that faces the cap side of insertion section 14 and plane θ1 of insertion hole 12 aligned to this plane, do not need to be tapered.

Figure 14:
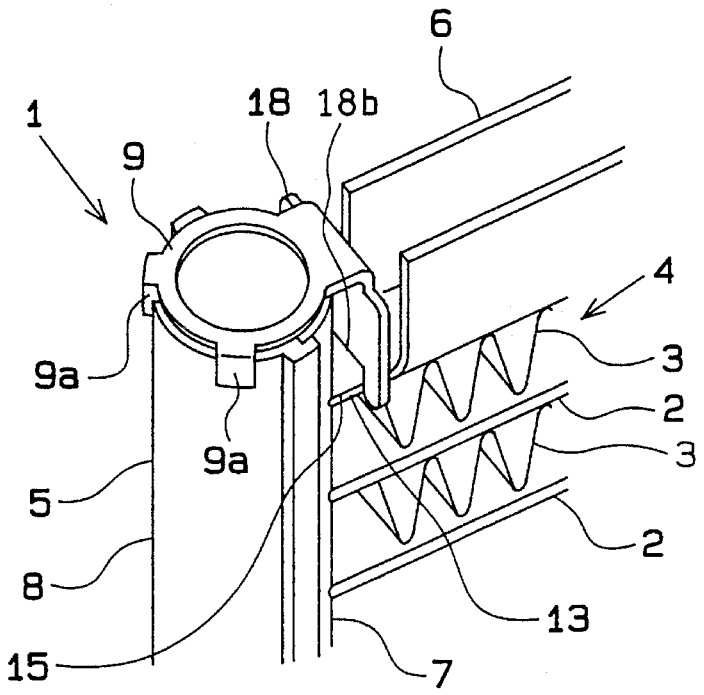
FIG. 14 is a partial perspective view of the heat exchanger according to a fourth embodiment of the present invention.
Figure 15:
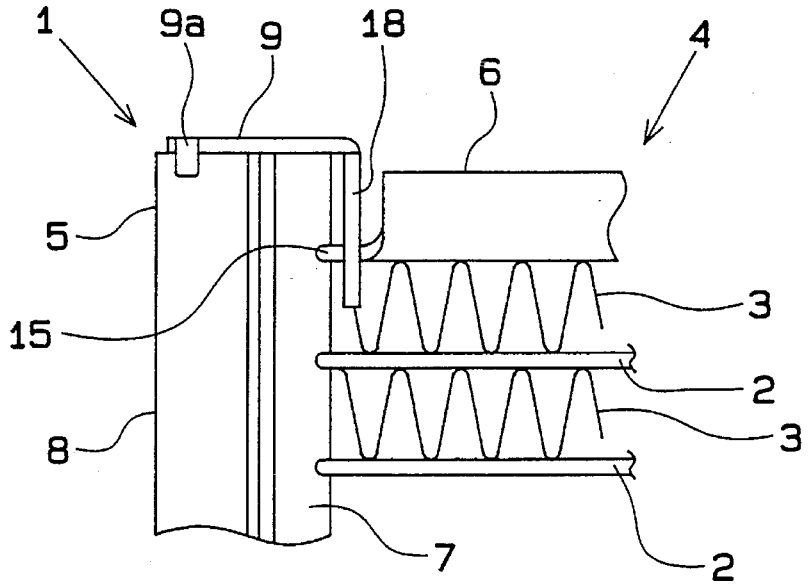
FIG. 15 is a partial side view of the heat exchanger in the fourth embodiment.
Figure 16:
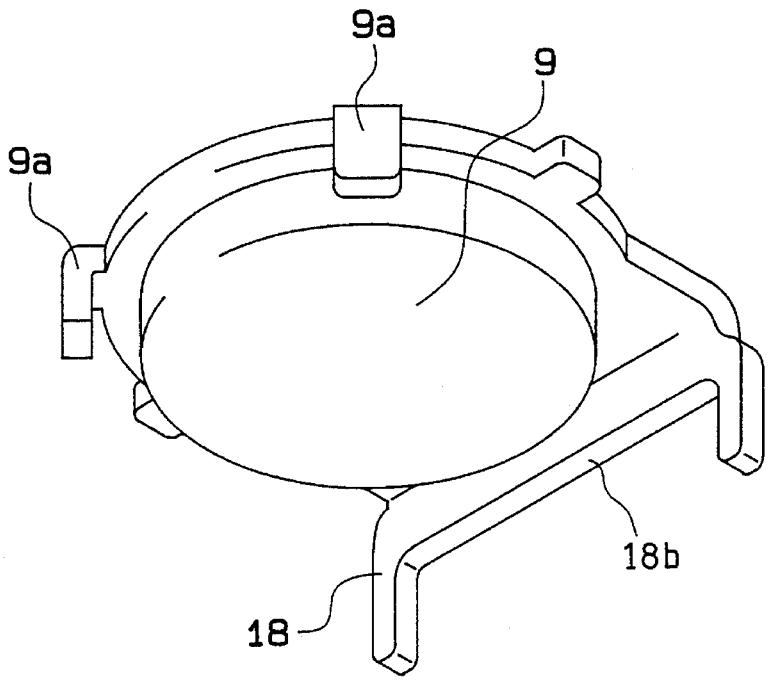
FIG. 16 is a perspective view of a cap including the coupling member.

FIGS. 14 to 16 illustrate a fourth embodiment according to the present invention. FIG. 14 shows a perspective view of heat exchanger 1, FIG. 15 shows a top view, and FIG. 16 shows a perspective view of cap 9 including coupling member 18.

In the fourth embodiment, cap 9 and side plate 6 are coupled with coupling member 18. Coupling member 18 is integrated onto cap 9. In this embodiment, coupling member 18 has a ⊐-shaped portion 18b that sandwiches flat section 15 of side plate 6 from both sides. This coupling member 18 is brazed and joined in the state where flat section 15 is sandwiched thereby.

As in the first embodiment, in the fourth embodiment of the present invention, header 5 and side plate 6 are coupled with connecting bar 13 and coupling member 18 so the strength of heat exchanger 1 is higher than in a conventional structure.

Figure 17:
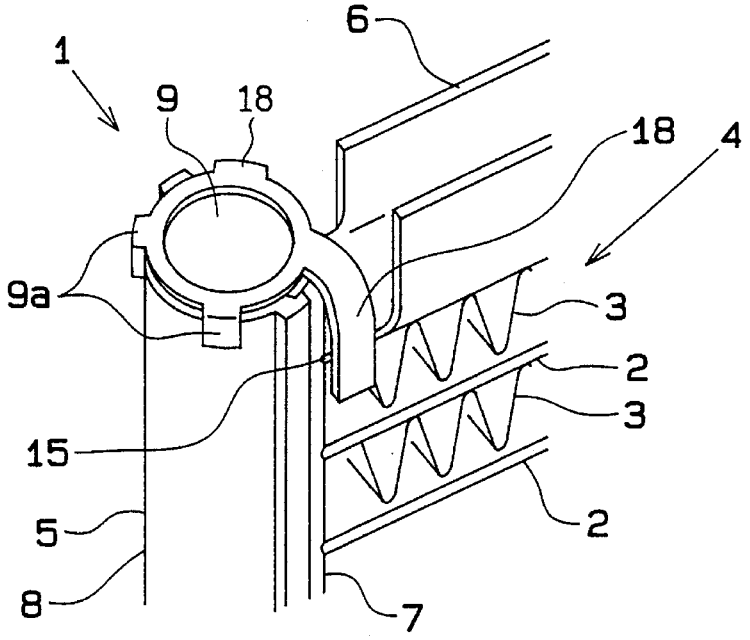
FIG. 17 is a partial perspective view of the heat exchanger according to a fifth embodiment of the present invention.
Figure 18:
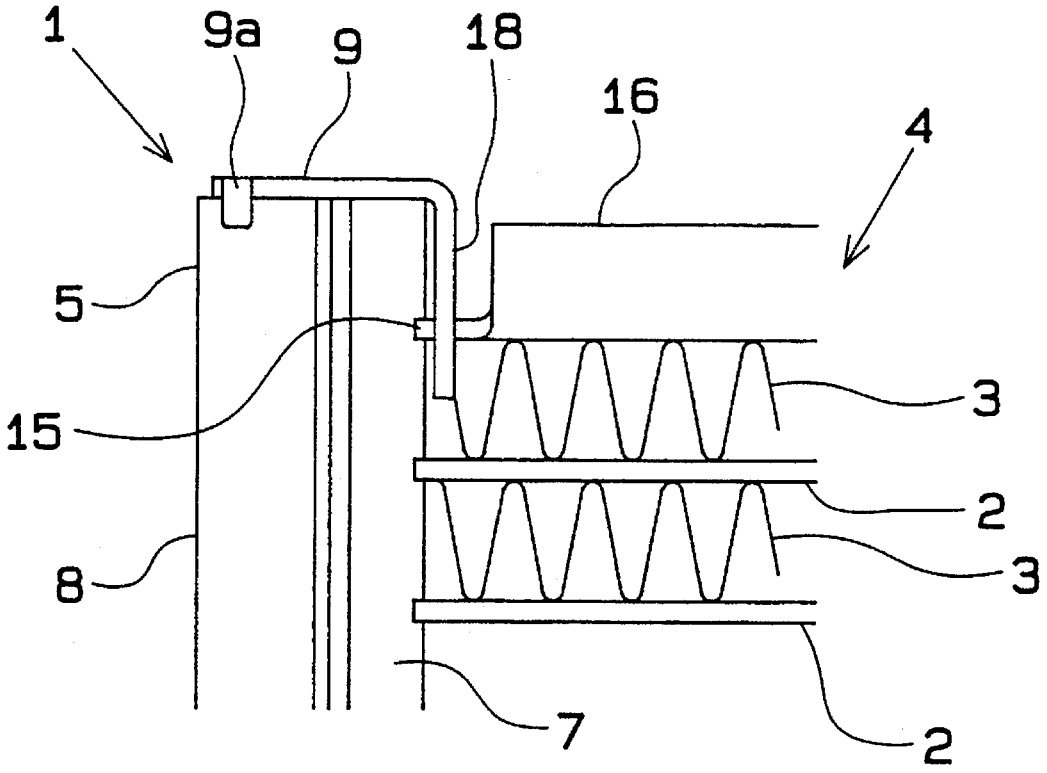
FIG. 18 is a partial side view of the heat exchanger in the fifth embodiment.

FIGS. 17 and 18 depict a fifth embodiment of the present invention. FIG. 17 shows a perspective view of heat exchanger 1, and FIG. 18 shows a side view of heat exchanger 1.

As in the fourth embodiment, coupling member 18 is integrally formed with cap 9. Two coupling members 18 like legs extend from cap 9 so that flat section 15 of side plate 6 is sandwiched from both sides by two coupling members like legs.

Figure 19:
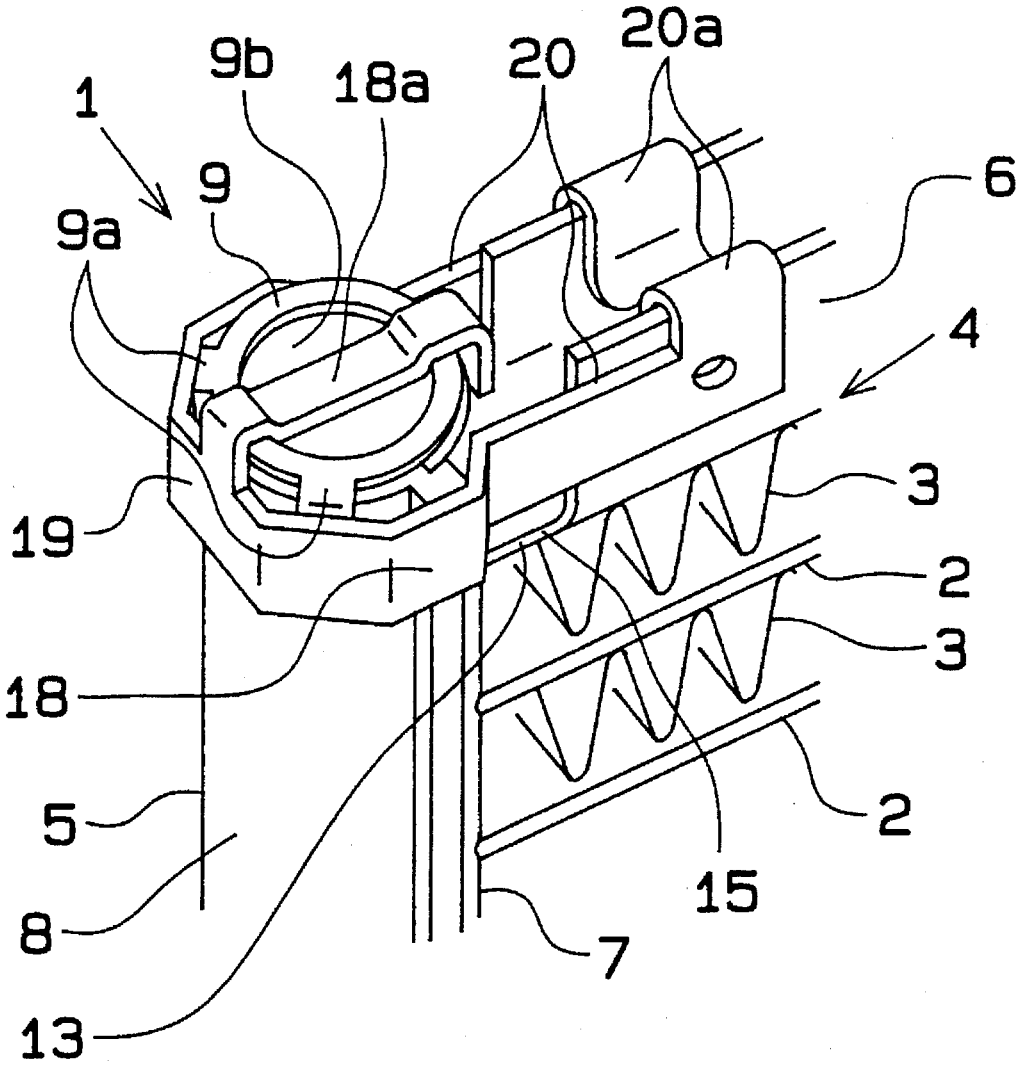
FIG. 19 is a partial perspective view of the heat exchanger according to a sixth embodiment of the present invention.

FIG. 19 shows a sixth embodiment of the present invention. FIG. 19 illustrates a perspective view of heat exchanger 1 according to this embodiment.

In the sixth embodiment, fitting bar 18*a* that fits into indent 9*b* of cap 9 is formed on arc section 10 of coupling member 18, which is configured of approximately U-shaped coupling member 19 attached to arm sections 20. Fitting bar 18*a* is brazed onto cap 9.

Figure 20:
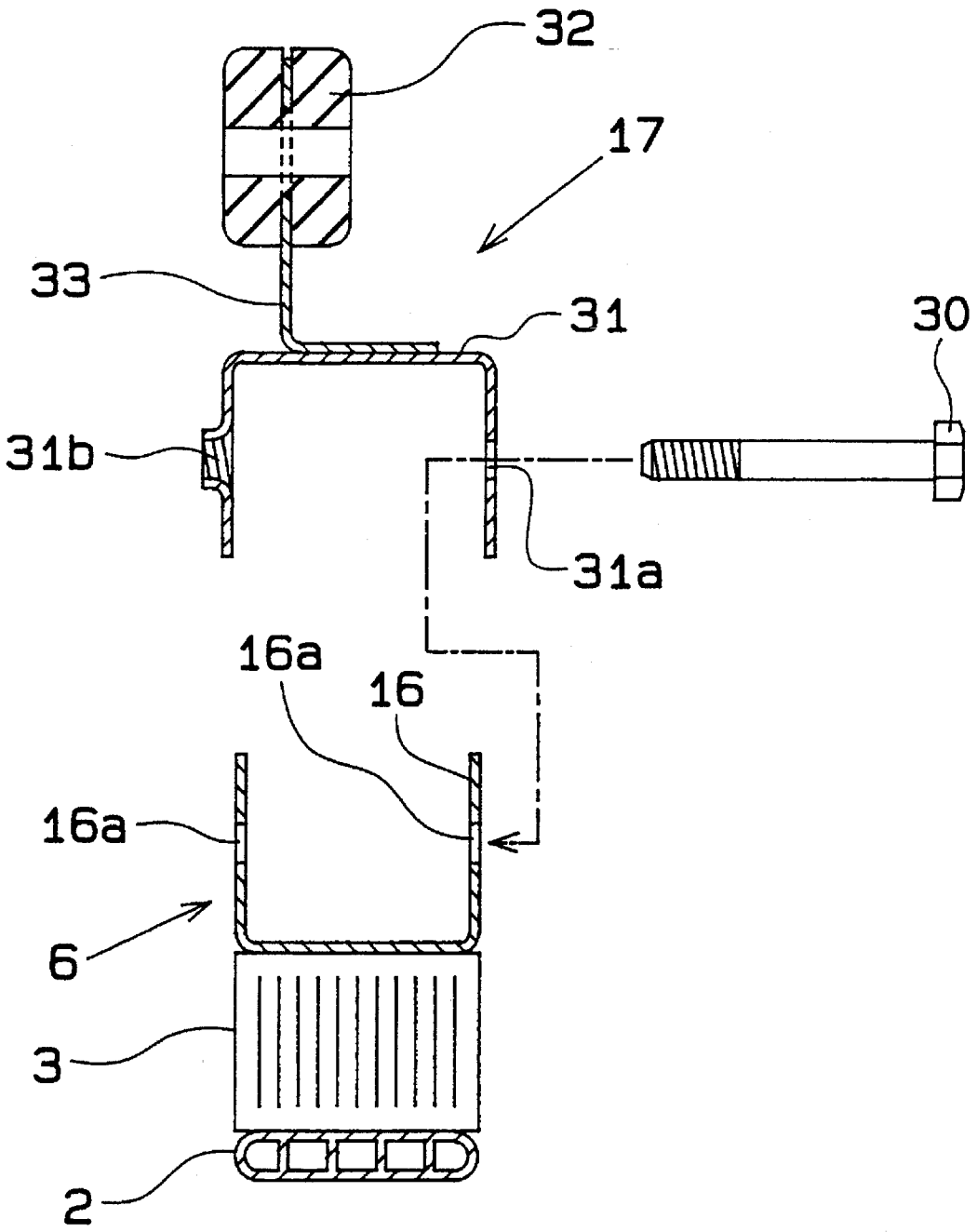
FIG. 20 is an exploded cross-sectional view of the bracket installed on the side plate of the seventh embodiment.
Figure 21:
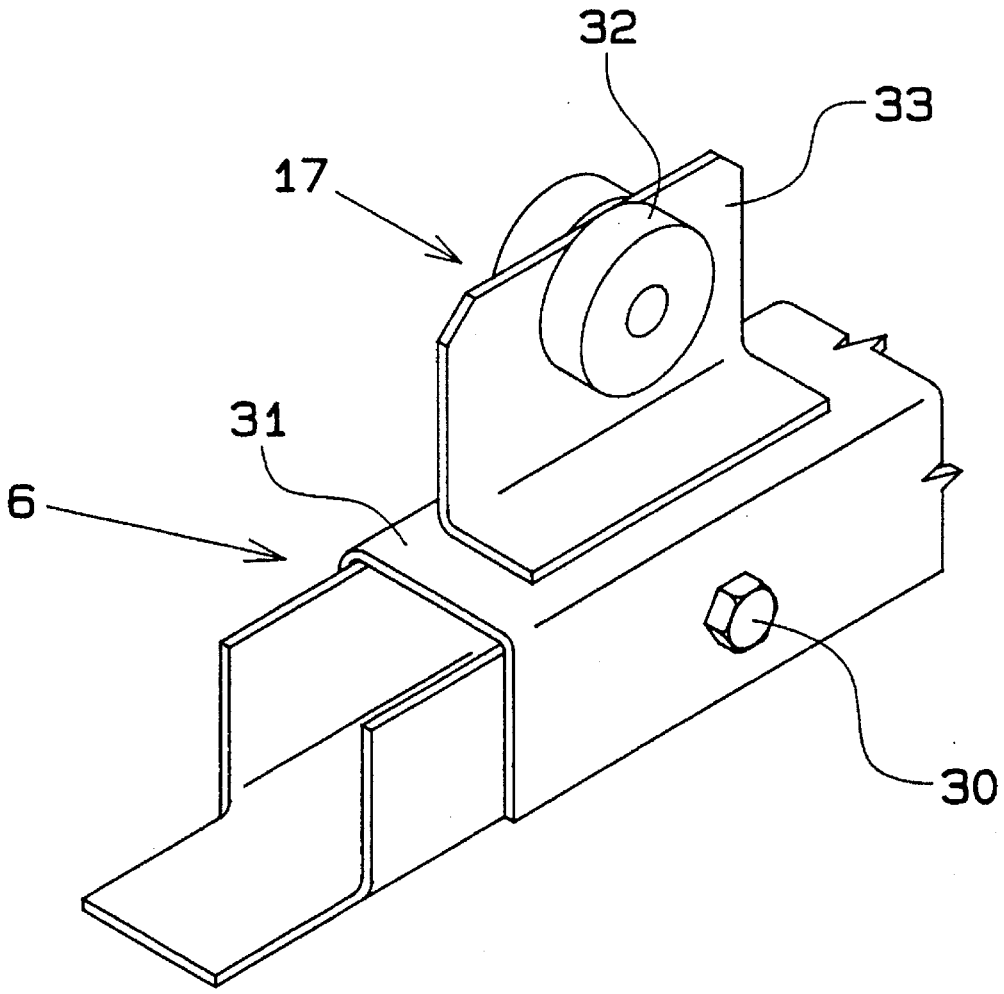
FIG. 21 is a perspective view of the bracket installed on the side plate in the seventh embodiment.

FIGS. 20 and 21 illustrate a seventh embodiment of the present invention. FIG. 20 is an exploded cross-sectional view of bracket 17 installed on side plate 6 of heat exchanger 1. FIG. 21 shows a perspective view of bracket 17 installed on side plate 6.

Bracket 17 used in this embodiment is installed on the ⊐-shaped bend section 16 of side plate 6 with bolt 30. Bracket 17 is configured to have a cross-sectional ⊐-shape base 31 installed on the ⊐-shaped bend section 16 in the state that the ⊐-shaped bend section 16 is sandwiched from both sides, and L-shaped cross-section coupler 33 installed on the vehicle with ring-shaped vibration-proof rubber 32. Base section 31 and coupler 33 are strongly joined by welding or the like.

Two holes 16*a* are formed on the ⊐-shaped bend section 16 into which bolt 30 is inserted. Holes 16*a* are larger than the screw diameter of bolt 30. Of the two holes in the base section 31 into which one bolt 30 is inserted, hole 31*a* is larger than bolt 30's screw diameter. Hole 31*b* has female threads in which bolt 30 is tightened and connected. The section in which female threads are formed is set to protrude outward with burring, and the length of the female threads are long.

Figure 22:
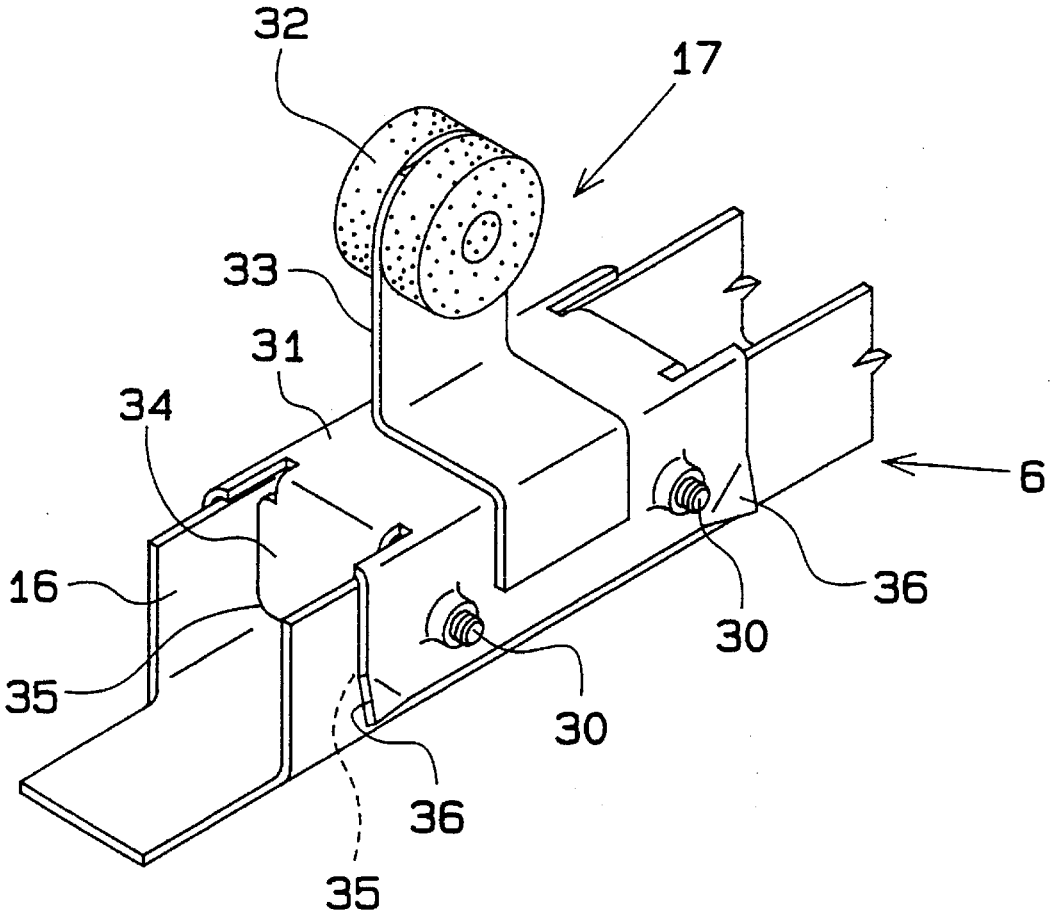
FIG. 22 is a perspective view of the bracket installed on the side plate according to the eighth embodiment of the present invention.
Figure 23:
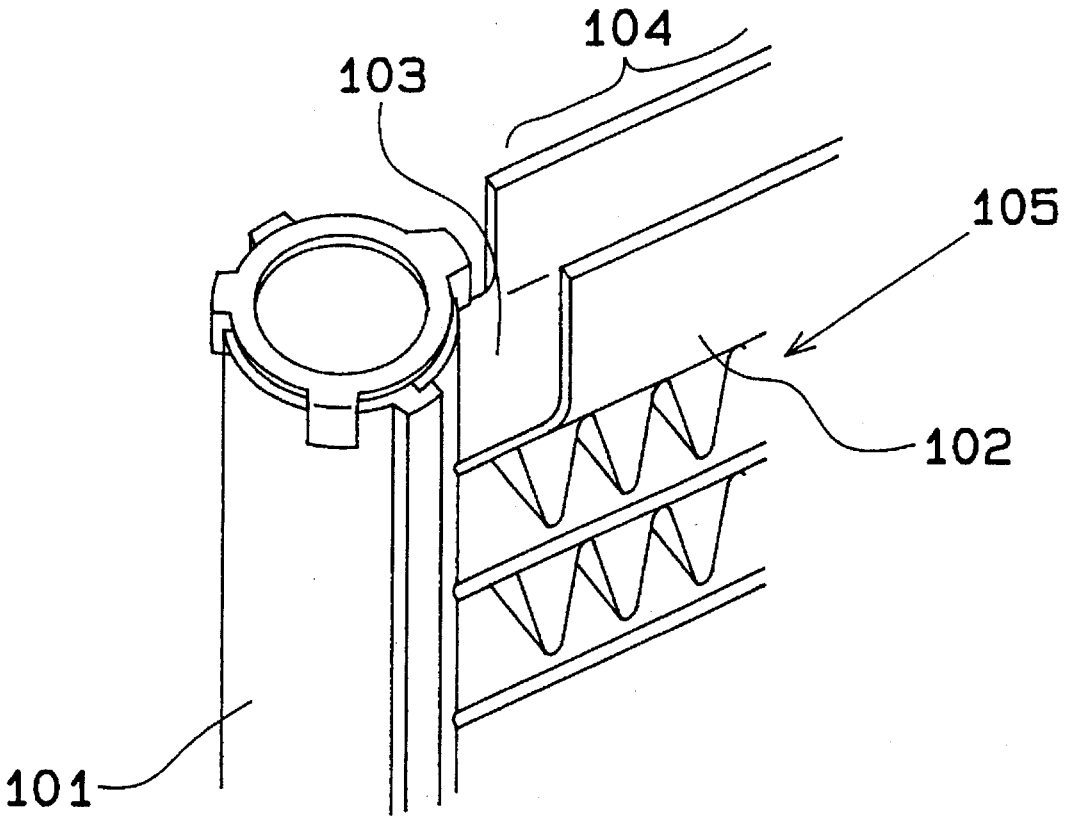
FIG. 23 PRIOR ART
FIG. 23 is a partial perspective view of the heat exchanger in the prior art.

FIG. 22 illustrates an eighth embodiment of the present invention. FIG. 22 is a perspective view of the eighth embodiment, and shows bracket 17 installed on side plate 6.

As in the seventh embodiment, bracket 17 is joined by welding base section 31 with coupler 33. One bracket 17 is installed onto the ⊐-shaped bend section 16 of side plate 6 with two bolts 30.

Both ends of base section 31 in this embodiment have claws 34 which are bent toward the inside of the ⊐-shaped bend section 16. Claws 34 are sandwiched by the ⊐-shaped bend section 16, and restrict inward bending of the ⊐-shaped bend section 16. Claws 34 in this embodiment are formed slightly inward from base section 31. In other words, these are set near bolt 30. This prevents inward bending of base section 31 and ⊐-shaped bend section 16 by the tightening force of bolt 30 when bolt 30 is screwed into the female threads. The interval of bolts 30 is set to be separated by approximately 30 mm or more.

On the corners of claws 34 on the sides where the ⊐-shaped bend section 16 is inserted are chamfered sections 35 that are chamfered for example in an R-shape. When the ⊐-shaped bend section 16 is inserted into base section 31, even if the ⊐-shaped bend section 16 is bent slightly inward, the ends contact the chamfered section 35 so that the ⊐-shaped bend section 16 is guided to both sides of claw 34.

On the four corners of base section 31 on the side where the ⊐-shaped bend section 16 is inserted is outward bent section 36. When the ⊐-shaped bend section 16 is inserted into base section 31, even if the ⊐-shaped bend section 16 is bent slightly outward, the ends contact outward bent section 36 so that the ⊐-shaped bend section 16 is guided into the inside of base section 31.

In the above embodiments, the heat exchanger is used with a refrigerant condenser for a freezing cycle. The heat exchanger may also be used for gas-to-gas heat exchangers, gas-to-liquid heat exchangers, and liquid-to-liquid heat exchangers such as a refrigerant evaporator, heater core, radiator, oil cooler or intercooler.

The present invention has been described in connection with what are presently considered to be the most practical and preferred embodiments. However, this invention is not meant to be limited to the disclosed embodiments, but rather is intended to cover all modifications and alternative arrangements includes within the spirit and scope of the appended claims.

What is claimed is:

1. A heat exchanger having a plurality of tubes with an internal fluid path and a core created by laying said tubes with corrugated fins having a wavy form, said heat exchanger comprising:

a header engaged to ends of said tubes; and a pair of side plates, having a connecting bar fixed to said header, that sandwich said core from both sides, thereof;

wherein said header and side plates are coupled with coupling members other than said connecting bar, said coupling members including an arc section brazed to said header and arm sections extending from said arc section.

2. A heat exchanger according to claim 1, wherein said connecting bar includes an insertion section and said header includes an insertion hole into which said insertion section fits.

3. A heat exchanger according to claim 2, wherein an end of said insertion section is tapered as are walls of said insertion hole.

4. A heat exchanger according to claim 3, wherein said insertion section is formed to have a hook-shape.

5. A heat exchanger according to claim 1, wherein said side plates include a section thereof formed in a reverse c-shape.

6. A heat exchanger having a plurality of tubes with an internal fluid path and a core created by laying said tubes with corrugated fins having a wavy form, said heat exchanger comprising:

a header engaged to ends of said tubes; and a pair of side plates, having a connecting bar fixed to said header, that sandwich said core from both sides thereof;

wherein said header and side plates are coupled with coupling members other than said connecting bar, and wherein each said side plate comprises a bracket for installing said heat exchanger to a vehicle body, said bracket comprising a reverse c-shaped base section to fit said side plate, a coupler connected to said reverse c-shaped base section at a first end thereof and a rubber element connected to said coupler at a second end of said coupler.

7. A heat exchanger according to claim 6, wherein said connecting bar includes an insertion section and said header includes an insertion hole into which said insertion section fits.

8. A heat exchanger according to claim 7, wherein an end of said insertion section is tapered as are walls of said insertion hole.

9. A heat exchanger according to claim 8, wherein said insertion section is formed to have a hook-shape.

10. A heat exchanger according to claim 6, wherein said side plates include a section thereof formed in a reverse c-shape.

11. A heat exchanger including multiple tubes having a fluid path formed internally, and a core created by layering a plurality of corrugated fins formed in wavy form with said tubes, said heat exchanger comprising:

a header including a cylinder engaged to ends of said tubes and a cap engaged to both ends of said cylinder to block the ends of the cylinder;

a pair of side plates having a connecting bar fixed to said header and which sandwich said core from both sides;

wherein each said cap and said side plate is coupled with a coupling member differing from said connecting bar; and wherein each said side plate comprises a bracket for installing said heat exchanger to a vehicle body, said bracket comprising a reverse c-shaped base section to fit said side plate, a coupler connected to said reverse c-shaped base section at a first end thereof and a rubber element connected to said coupler at a second end of said coupler.

12. A heat exchanger according to claim 11, wherein said connecting bar includes an insertion portion and said header includes an insertion hole therein, said insertion portion having means for coupling said insertion portion to said insertion hole.

13. A heat exchanger according to claim 11, wherein each said cap and said coupling member is integrally formed.

14. A heat exchanger according to claim 13, wherein said cap and said coupling member integrally formed has a means for sandwiching a flat section of said side plate.

15. A heat exchanger according to claim 11, wherein said coupling member includes a fitting bar adapted to fit in an indentation formed on said cap.

* * * * *